US005358724A

United States Patent [19]

Raffaele

[11] Patent Number: 5,358,724

[45] Date of Patent: Oct. 25, 1994

[54] DOUBLE CHAMBER INFUSION BAG AND METHOD OF MANUFACTURE

[76] Inventor: Peter R. Raffaele, Park Avenue, Manilla, New South Wales 2346, Australia

[21] Appl. No.: 934,472

[22] PCT Filed: Mar. 13, 1991

[86] PCT No.: PCT/AU91/00093

§ 371 Date: Sep. 11, 1992

§ 102(e) Date: Sep. 11, 1992

[87] PCT Pub. No.: WO91/13580

PCT Pub. Date: Sep. 19, 1991

[30] Foreign Application Priority Data

Mar. 14, 1990 [AT] Austria ..... PJ 9069
Mar. 26, 1990 [AT] Austria ..... PJ 9305

[51] Int. Cl.[5] ..... B65B 29/02; B65B 61/14

[52] U.S. Cl. ..... 426/79; 426/80; 426/83; 426/394; 53/134.2

[58] Field of Search ..... 426/77-84, 426/394; 206/0.5; 99/279, 287; 53/134.2, 413

[56] References Cited

U.S. PATENT DOCUMENTS 1,723,702 8/1929 Mitchell .
1,775,347 9/1930 Hirschhorn .
2,308,241 1/1943 Hogaboom .
2,362,459 11/1944 Barnett ..... 206/0.5
2,466,281 4/1949 Shaw ..... 426/80
2,800,408 7/1957 Fimple .
2,878,927 3/1959 Haley .
2,881,910 4/1959 Murphy ..... 426/80
2,986,269 5/1961 Goldberg .
3,053,665 9/1962 Irmscher ..... 426/79
3,237,550 3/1966 Christopher .
3,396,032 8/1968 McCrae .
3,415,656 12/1968 Lundgren ..... 426/80
3,539,355 11/1970 Kasakoff .
4,680,185 7/1987 Illk .
4,735,810 4/1988 Dacal .

FOREIGN PATENT DOCUMENTS

21802/83 11/1983 Australia .

*Primary Examiner*—Michael Ball
*Assistant Examiner*—Richard Crispino
*Attorney, Agent, or Firm*—Leydig, Voit & Mayer, Ltd.

[57] ABSTRACT

The invention provides an improved infusion bag, for containing tea, coffee or the like. The bag (10) incorporates means for compression, such as string (12) which is attached to bag (10), for example at its base (14) by knot (16). The bag of the invention may be single chambered or double chambered, inter alia. The invention also provides a method of manufacturing the bag.

6 Claims, 2 Drawing Sheets

DOUBLE CHAMBER INFUSION BAG AND METHOD OF MANUFACTURE

FIELD OF THE INVENTION

This invention relates to infusion bags and the like; more particularly, this invention concerns an improvement intended to overcome some of the drawbacks presently associated with such bags.

BACKGROUND OF THE INVENTION

The infusion bags relevant to this invention are those of the type which contain a measured quantity of substance enclosed in a membrane. Such bags are intended for infusion, for example in a hot liquid, and may incorporate a handle to facilitate both the suspension of the bag in the infusion liquid and the removal of the bag from the liquid. In some forms, the handle constitutes a short length of string stapled or glued to the bag. The free end of the string may have a tag attached for easy handling.

The bag itself may take any number of configurations. The most common form of bag represents a simple envelope or pouch, with walls of a thin porous paper-type material sealed on all edges (the "single chamber" bag). Another form of bag comprises a short length of tube or similar material. The free ends of the tube are fixed together so that the tube forms a loop which may be folded to any desired configuration (the "double chamber" or "flow-through" bag). In yet another form, the bag may be spherical or drop-shaped. It is to be understood that the present invention is applicable to all types of infusion bags, whatever their precise shape.

It is well recognised that infusion bags have gained immense popularity in recent years. In particular, infusion bags containing tea or herbs are in common use in many parts of the world and billions of such bags are sold every year.

While an infusion bag has many advantages and is generally convenient to use, it does suffer from two major drawbacks. The first arises after the bag has been immersed in the infusion liquid for the required period of time and it is desired to remove the bag from the liquid. It is invariably the case that residual liquid drips from the bag as it is withdrawn and care must be taken to ensure that the dripping liquid does not wet or stain surrounding surfaces or material.

The second drawback relates to the extraction of maximum flavour from the infusion bag. Simple infusion is not always sufficient for this purpose. Where the infusion bag is provided with a handle, the bag may be stirred through the infusion liquid by using the handle to oscillate (or "jiggle") the bag through the liquid and this can aid extraction. However, this method falls short of effecting maximum extraction.

Both drawbacks have been recognised and there have been attempts to overcome the drawbacks. For example, where the infusion bag is intended to be used to produce a cup of tea, some users employ a teaspoon or similar implement to squash the teabag between the teaspoon and the internal surface of the cup while this method can assist in extracting extra tea flavour from the bag, the method has very little success in preventing drips unless the bag can be held clear of the infusing liquid (hot water) during the operation. Normally, there is a maximum of two centimetres between the surface of the water in the cup and the lip of the cup. As a result, there is inadequate dry cup surface and the squashing method is not very effective. There is also the substantial danger that pressure on the inside surface of the cup, adjacent the lip, will cause the cup to tip and spill its contents.

In another prior art attempt to overcome the aforesaid drawbacks, a pair of tongs has been provided for squeezing infusion liquid and flavour from the bag. This method is somewhat more successful than the first method described above. However, one of the main advantages of infusion bags is their convenience in terms of storage and transportation, as well as their low manufacturing cost. It is not always convenient to have access to a pair of tongs for use with infusion bags; the provision of one of more pairs of tongs in cartons of infusion bags would add substantially to costs.

More sophisticated attempts to overcome these problems are disclosed in U.S. Pat. No. 2,878,927 (Haley), in U.S. Pat. No. 3,327,550 (Christopher) and in U.S. Pat. No. 3,396,032 (McCrae et al). However, each of these attempts involves a combination of an external harness on the infusion bag coupled with complicated means for tightening the harness and squeezing the bag.

It is an aim of the present invention to provide an improvement which overcomes or substantially alleviates the drawbacks referred to above and which moreover is inexpensive to implement.

Accordingly, this invention provides an improved infusion bag having a base and an apex and incorporating means for compressing the bag, characterised in that the compression means are provided in the form of a flexible handle at least a portion of which is located within the bag, the flexible handle being secured at or near the base and adapted to pass slidably through a substantial portion of the bag so that said handle is capable of compressing said bag by drawing said apex towards said base.

The invention also provides a method of manufacturing an improved infusion bag, comprising the steps of forming a bag and incorporating in the bag at least a portion of the compression means.

In a preferred embodiment of the infusion bag of the invention, the flexible handle is a string, forming a loop secured to the bag in at least one location in addition to the base. In use, the free end of the string (which may or may not have a tag attached) may be used to suspend the bag in the infusing liquid until it is desired to remove the bag from the liquid. At that time, as the bag is lifted clear of the infusing liquid by means of the string, the bag is compressed by sliding the bag along the string towards the base of the bag.

This compression action removes a substantial portion of infusing liquid from the bag and may also have the effect of maximising extraction of flavour from the bag. It is found that once the compressive force on the bag is released, provided the bag is still above the surface of the infusing liquid, there is insufficient infusing liquid remaining in the bag to cause dripping.

The compression means of the invention may be adapted to any configuration of infusion bag and may comprise systems other than that described above. Some of those other systems are described below.

The flexible handle, which may be a string or the like, may consist of a multi-stranded string, with different strands being attached to various parts of the bag. The purpose of this configuration may be to enhance compression of the bag, or to facilitate manufacture, or both.

In another form of the invention, the string may form a loop which is threaded through the bag or which is fixed to the bag in one or more locations.

In yet another form of the invention, two or more strings may be provided in order to enhance compression of the bag and/or to facilitate manufacture. The manner of fixing the string to the bag (or each string, if more than one) includes any method which is effective and convenient, including the use of knots, staples, glue, threading and the like. Depending on the effect desired, the method of fixing the string to the bag may permit the string to slide through the bag, or else the string may be anchored to the bag at one or more sites so that the string cannot slide through the bag at those sites. The choice of manner of fixing the string to the bag in any given configuration will be determined by the objectives in each situation and the range of choices will be readily apparent to one skilled in the art.

If desired, the improved infusion bag according to the invention may include means to facilitate compression of the bag. For example, where the handle is a short length of string it may be provided with a tag, button or similar device, slidably mounted on the string between the bag and the free end of the string, so that the device may be used to assist the compression by the user's fingers and to prevent scalding by contact with hot infusing liquid. In this embodiment, the tag may be releasably fixed to the free end of the string so that the bag resembles a conventional bag, with the tag carrying the usual manufacturer's trade mark, for example. However, when the bag is to be compressed, the tag is released from the end of the string and is able to slide towards the bag as already described. Where the string is multi-stranded or more than one string is provided, it is preferred that the means for facilitating compression of the bag, if used, are slidably mounted on all strands of the string or on all strings.

If desired, the bag may be manufactured so that the means for facilitating compression of the bag (such as a tag) are an integral part of the bag. For example, the tag may comprise a part of the bag as described in Australian Patent No. 118,215 (Sailsberg), with the zone where the tag joins the bag being weakened by perforations or the like, so that the tag, with string attached, may be detached from the remainder of the bag before infusion.

The invention is applicable to both single and double chambered infusion bags, inter alia. In the case of double-chambered bags, in which each chamber is attached to the other at the base and the apex, the string forming the compression means may be fastened at the base of the bag, so that the string passes between the two chambers through the apex. In this event, it may be desirable to fix the two chambers of the bag together (for example, by using glue or heat-sealing) at an additional point between the base and the apex so that during compression the two chambers do not fall away from the string, making compression less effective.

It will be noted that the compression means is regarded as within the infusion bag in accordance with the invention when the compression means passes between the two chambers.

BRIEF DESCRIPTION OF THE DRAWINGS

Certain embodiments of the infusion bag of the invention, as well as one embodiment of a method of manufacturing the infusion bag of the invention, are described below in connection with the Drawings, in which.

In the Drawings, like parts carry the same numbers for ease of reference.

Figure 1:
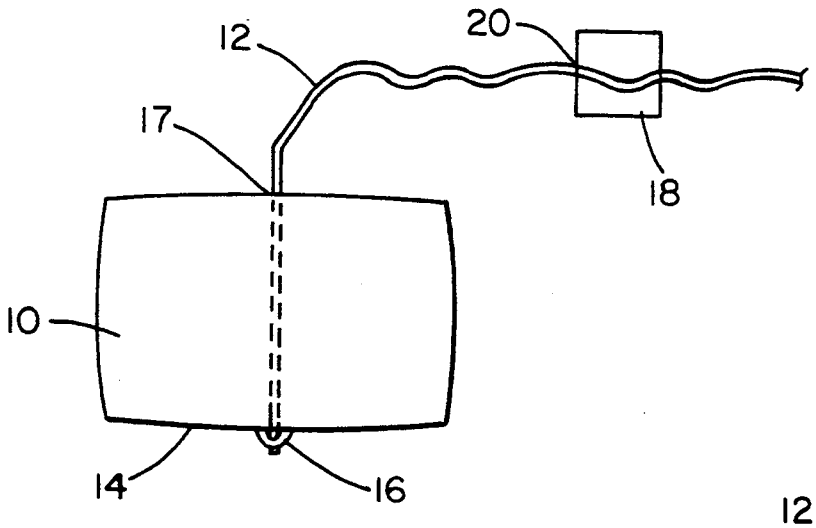
FIG. 1 is a front elevation of one form of an improved infusion bag according to the invention.

Referring first to FIG. 1, bag 10 is of conventional envelope type ("single chamber") and contains tealeaves or other infusable material (not shown). Suspension string 12 passes through bag 10 (as shown in dotted outline) and is retained at a point on base 14 of bag 10 by a knot 16. String 12 also passes through apex 17 and tag 18 and is secured thereto by a weak staple or loop 20.

To compress bag 10, tag 18 is urged towards bag 10 until loop 20 releases the tag, which is then able to travel down string 12 to apex 17. Continued pressure on tag 18 towards base 14 while string 12 is held taut results in compression of bag 10 with the resultant expulsion of liquid and flavour therefrom.

Figure 2:
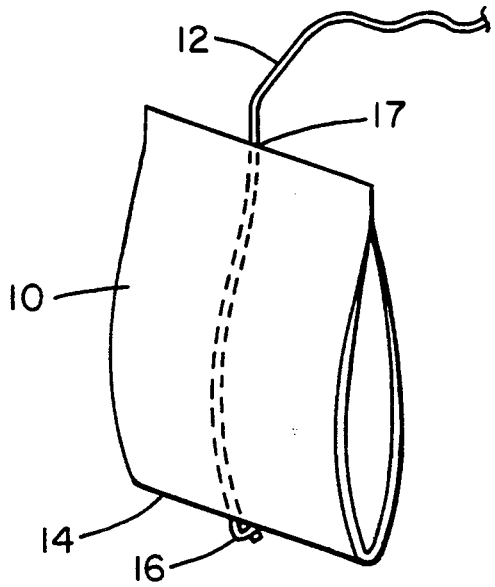
FIG. 2 is a perspective view of a second form of an improved infusion bag according to the invention.

In FIG. 2, infusion bag 10 is of the folded tube type ("double chamber"). Compression is effected in much the same fashion as in the case of the embodiment described in FIG. 1, except that because the free end of string 12 has no tag, compression is effected by the user sliding his fingers along string 12 towards apex 17 of bag 10 and then continuing to compress bag 10 towards base 14. The two chambers undergo effective compression because they are held together by heat sealing (not shown), located approximately midway between base 14 and apex 17.

Figure 3:
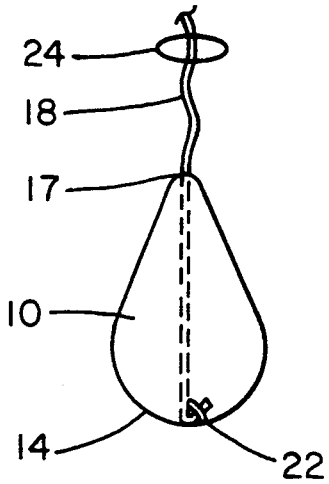
FIG. 3 is a front elevation of a third form of improved infusion bag in accordance with the present invention.

The infusion bag in FIG. 3 is drop or tear-shaped. String 12 is secured inside bag 10 near base 14 by means of a staple or loop 22. Disc 24 on string 12 can be employed to assist compression of bag 10 in the same manner as tag 18 in FIG. 1.

Figure 4:
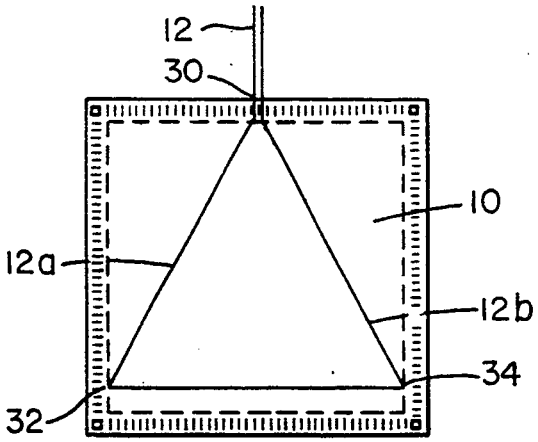
FIG. 4 is a diagrammatic view of a fourth embodiment of infusion bag.

Referring to FIG. 4, bag 10 is of conventional envelope type ("single chamber") and contains tealeaves or other infusable material (not shown). Suspension string 12 is double-stranded and enters bag 10 at aperture 30, Thereafter, the two strands of string 12 are separated into strand 12*a* and strand 12*b* which are fixed to bag 10 at points 32 and 34. The manner of fixing may be by threading the strands through bag 10, optionally knotting each strand and returning each strand into bag 10. Alternately, strands 12*a* and 12*b* may be stapled to the bag at points 32 and 34. The use of knots will obviously prevent strands 12*a* and 12*b* from sliding through the bag 10. On the other hand, the threading of the strands through bag 10, without knotting, or the use of suitable staples, will permit sliding of strands 12*a* and 12*b*.

The choice of the manner of fixing will determine the effect when bag 10 is compressed.

Figure 5:
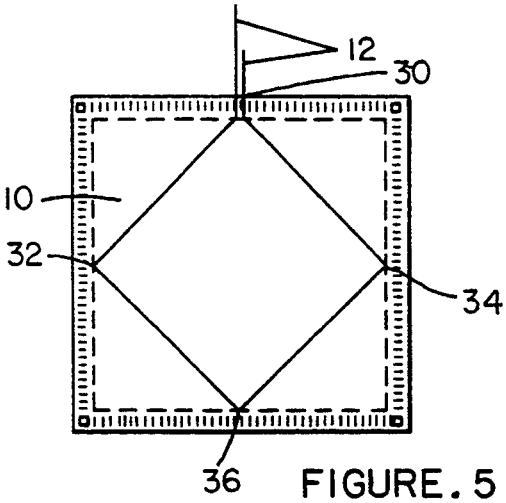
FIG. 5 is a diagrammatic view of a fifth embodiment.

In FIG. 5, string 12 forms a loop entering bag 10 at aperture 30 and is fixed to bag 10 at points 32, 34 and 36. The manner of fixing may be any of those described in connection with FIG. 4.

Figure 6:
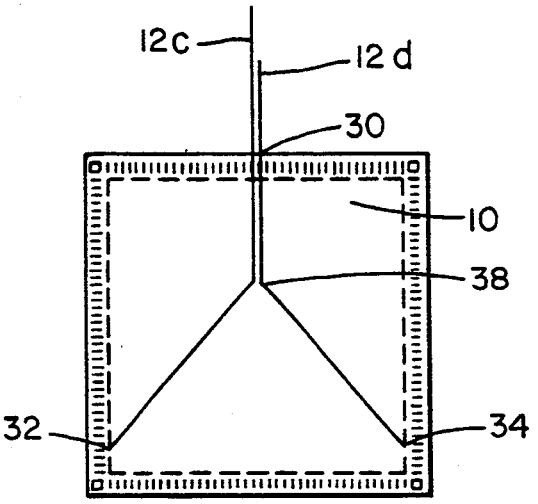
FIG. 6 is a diagrammatic view of a sixth embodiment.

In FIG. 6, the configuration is similar to that in FIG. 4, except that there are two strings 12*c* and 12*d* which enter bag 10 at aperture 30. String 12*c* is fixed to bag 10 at point 32, while string 12*d* is fixed to bag 10 at point 34. In this case, the manner of fixing does not permit strings 12*c* and 12*d* to slide through bag 10, except via aperture 30. Strings 12*c* and 12*d* are linked together at 38 by knotting together or similar means.

Figure 7:
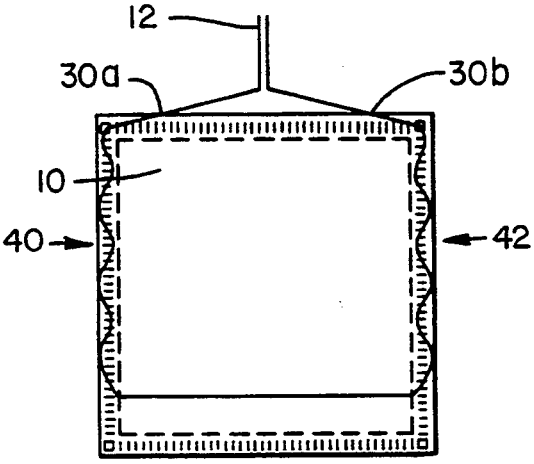
FIG. 7 represents a diagrammatic view of a seventh embodiment of the infusion bag of the invention.

Referring now to FIG. 7, string 12 forms a continuous loop, one part of which enters bag 10 at aperture 30*a* and the other part at aperture 30*b*. String 12 is threaded through the sides of bag 10 as generally indicated at 40 and 42 and is able to slide freely at the threading apertures.

Figure 8:
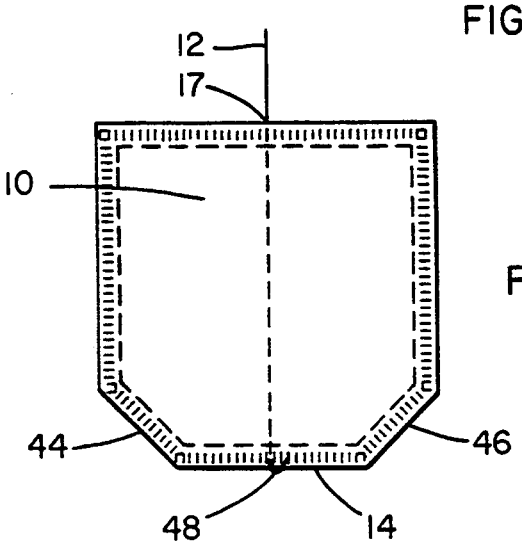
FIG. 8 represents a schematic view of an embodiment of the infusion bag of the invention, especially suitable for containing coffee.

In FIG. 8, bag 10 has a base 14 with cutaway corners 44 and 46. String 12 is secured to base 14 by looped stitching 48, or by a staple (not shown).

As indicated, the present invention also provides a method of manufacturing the improved infusion bag. A preferred embodiment of this will now be described.

In the production of a conventional "flow-through" or "double-chambered" tea bag, a length of filter paper is formed into a continuous "U" having upstanding arms. The filter paper has deposited upon it, in fixed dosages, two separate mounds of tea for each bag. The upstanding arms are then brought together, folded and sealed to form a long closed tube which is cut into smaller teabag tubes, each containing two mounds of tea.

Next, three cross-folds are made in the centre of each teabag tube so that a "W" is formed. The free ends of the tube are then brought together, folded in a triangular fashion and sealed by an aluminium staple. At this stage, one end of a cotton thread or string may also be fixed to the bag by the staple. If desired, the other end of the string may be fixed to a tag by a staple.

To manufacture a double-chambered infusion bag according to the invention, the conventional method of production may be followed, up to the stage of folding the free ends of the teabag tube in a triangular fashion. Instead of sealing the triangular folds with a staple, extra steps are required.

A needle threaded with a loop of string is inserted through the triangularly-folded top section. The needle travels towards the base of the bag, to the region of the centre cross-fold. A staple is applied to the cross-fold to restrain the string and lock it to the base of the bag while the needle retracts above the bag. The insertion of the staple at the base of the bag may take place at the same time as the insertion of the staple at the triangular apex of the bag. Thereafter, the infusion bag of the invention may be finished as with conventional bags: a tag may be applied to the free end of the string by means of a staple. Alternately, the tag may be slidably affixed to the string as described above.

It will be apparent to one skilled to the art that other embodiments of the infusion bag of the invention may be manufactured in a similar or different manner. The invention is not to be limited by the specific examples referred to herein, but only by the attached claims.

I claim:

1. An improved infusion bag comprising a double chamber, a base and an apex, each chamber being attached to the other at the base and apex, the bag incorporating means for compressing the bag, characterised in that the compression means are provided in the form of a flexible handle at least a portion of which is located within the bag, the flexible handle being secured at or near the base and adapted to pass slidably between said chambers, each chamber being additionally attached together in a region between the base and the apex, so that said handle is capable of compressing said bag by drawing said apex towards said base.

2. An improved infusion bag as claimed in claim 1, which further includes means to facilitate compression of the bag.

3. An improved infusion bag as claimed in claim 2, wherein the means for facilitating compression of the bag comprise one of a tag and button slidably mounted on the handle outside the bag.

4. An improved infusion bag as claimed in claim 2, wherein the means for facilitating compression of the bag form an integral part of the bag during manufacture and are adapted to be separated from the bag for use.

5. A method of manufacturing an improved infusion bag having a double chamber, a base and an apex, each chamber being attached to the other at the base and apex, the bag incorporating means for compressing the bag, characterized in that the compression means are provided in the form of a flexible handle at least a portion of which is located within the bag, the flexible handle being secured at or near the base and adapted to pass slidably between said chambers, each chamber being attached together between the base and the apex, so that said handle is capable of compressing said bag by drawing said apex towards said base, the method comprising the steps of forming the bag, having the double chamber, providing an additional point for attaching the chamber together in a region between the base and the apex, and incorporating in the bag at least a portion of the flexible handle.

6. A method of manufacturing an improved infusion bag having a double chamber, a base and an apex, each chamber being attached to the other at the base and apex, the bag incorporating means for compressing the bag, characterized in that the compression means are provided in the form of a flexible handle at least a portion of which is located within the bag, the flexible handle being secured at or near the base and adapted to pass slidably between said chambers, each chamber being attached together in a region between the base and the apex, so that said handle is capable of compressing said bag by drawing said apex towards said base, the method comprising the steps of:

forming a length of filter paper into a continuous "u" shape having a flat portion and upstanding arms;

depositing on said flat portion in fixed dosages two separate mounds of infusion material for each infusion bag to be formed;

folding and sealing said arms to form a tube;

cutting said tube into smaller infusion bag tubes, each containing two mounds of infusion material and having opposite open ends;

folding each smaller tube to form a "w" shaped cross-fold;

folding said ends in triangular fashion and sealing said opposite ends together to form the double chamber;

attaching the chambers together in a region between the apex and base of the bag;

inserting through the triangular fold so formed a needle threaded with string;

causing said needle and said string to travel to the center of said cross-fold;

stapling said string to said center; and stapling said string to said triangular fold so that said string is slidable within the staple.

* * * * *